United States Patent [19]

Bonneau

[11] Patent Number: 4,833,837

[45] Date of Patent: May 30, 1989

[54] FOLDING RADOME

[75] Inventor: Alain Bonneau, Auteuil, France

[73] Assignee: Societe D'Etudes Techniques Et D'Entreprises Generales Sodeteg, Le Plessis Robinson, France

[21] Appl. No.: 11,239

[22] Filed: Feb. 5, 1987

[30] Foreign Application Priority Data

Feb. 7, 1986 [FR] France ..... 86 01723

[51] Int. Cl.[4] ..... E04B 1/34

[52] U.S. Cl. ..... 52/2; 52/66

[58] Field of Search ..... 52/2 G, 2 J, 64, 66

[56] References Cited

U.S. PATENT DOCUMENTS

| | | | |
|---|---|---|---|
| 2,830,606 | 4/1958 | Daugherty | 52/2 J |
| 2,900,994 | 8/1959 | Igoe | 52/2 J |
| 3,332,176 | 7/1967 | Knetzer et al. . | |
| 4,012,867 | 3/1977 | Lainchbury et al. | 52/2 J |
| 4,106,520 | 8/1978 | Warner et al. | 52/66 X |
| 4,387,533 | 6/1983 | Green et al. | 52/2 G |
| 4,583,331 | 4/1986 | Hunt et al. | 52/2 G |

FOREIGN PATENT DOCUMENTS

| | | | |
|---|---|---|---|
| 1027727 | 3/1978 | Canada | 52/64 |
| 2849136 | 5/1979 | Fed. Rep. of Germany | 52/63 |
| 2066636 | 8/1971 | France . | |
| 2067435 | 8/1971 | France . | |
| 2130416 | 3/1972 | France . | |
| 2296072 | 7/1976 | France . | |
| 2370137 | 6/1978 | France . | |
| 2444763 | 8/1980 | France | 52/63 |
| 964081 | 10/1982 | U.S.S.R. | 52/66 |
| 1388050 | 3/1975 | United Kingdom | 52/2 N |

*Primary Examiner*—David A. Scherbel
*Assistant Examiner*—Creighton Smith
*Attorney, Agent, or Firm*—Oblon, Fisher, Spivak, McClelland & Maier

[57] ABSTRACT

Radome for protection from atmospheric influences, with a folding, rigid reinforcing structure and a flexible roofing comprising one or more parts; a radome wherein, in order to prevent any formation of pockets, this roofing is made with a double wall and is sectioned into lens-shaped panels which are independent of one another and are inflatable.

16 Claims, 3 Drawing Sheets

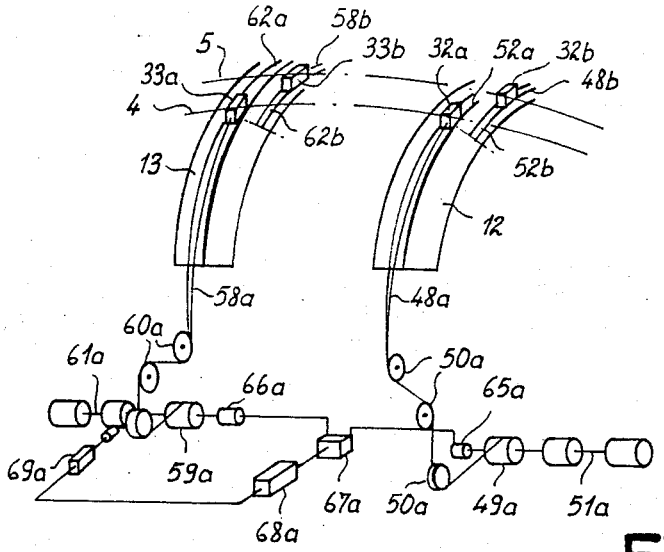
FIG_10
FIG_13
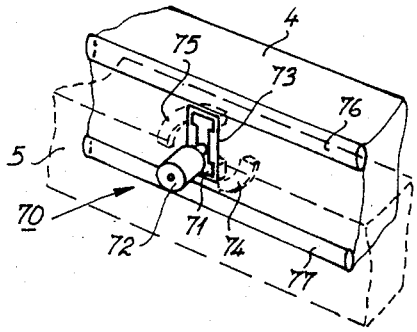
FIG_11
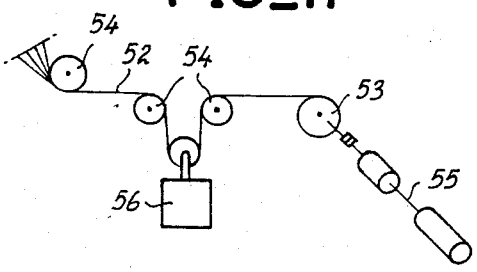
FIG_12
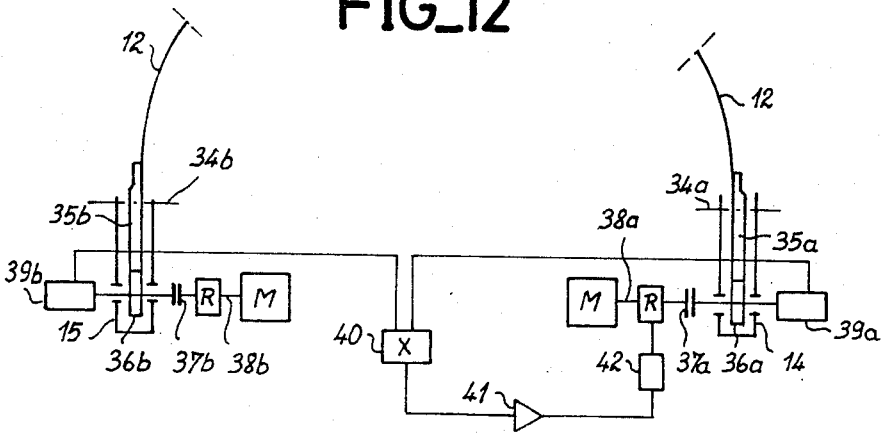

FOLDING RADOME

BACKGROUND OF THE INVENTION

1. Field of the Invention

The present invention pertains to a folding radome designed to protect relatively large-sized equipment, such as telescopes, radars, telecommunications antenna, etc. and, possibly, military, industrial and sports installations, from atmospheric influences.

2. Description of the Prior Art

Until now, such equipment has been given protection from atmospheric influences, either by rigid domes with windows or inflatable radomes with screened openings. In these rigid domes or inflatable radomes, the window or opening which enables unhampered communication with the external atmosphere usually comprises a fixed position or orientation by which it is difficult, if not practically impossible, to change without rendering the very installation of these facilities expensively mobile.

A limitation of unhampered communication with the external atmosphere through the fixed orientation of this window or opening sometimes becomes a major disadvantage in the running of certain installations such as one protecting an installation for astronomical observation, for example a telescope. Besides, radomes of the prior art often are either radomes with fixed, metallic, reinforcing structures or inflatable radomes without metallic, reinforcing structures. A radome with a fixed, metallic, reinforcing structure is a radome provided with a fixed, solid, metallic frame mounted on a rigid substructure and lined with an impermeable, flexible cover. Such radomes stand up well to atmospheric influences and strong wind owing to their solid metallic frames. However, for an installation in a place which is poorly accessible to transport vehicles, for example a place located in a mountainous region surrounded by thick forest without practical means of access, the transportation of equipment and materials for building this solid frame of the radome raises problems that are difficult to resolve in an economical way. Inflatable radomes without metallic reinforcing structures, according to the prior art, are often radomes with flexible covers held in position by beams in the form of flexible, cylindrical tubes, inflated under a predetermined pressure which makes them rigid in varying degrees. These radomes of the prior art are light but are more or less vulnerable to strong winds and do not withstand these winds when one or more of these beams are deflated following an accidental leak or a puncture.

SUMMARY OF THE INVENTION

The present invention, aimed at avoiding these disadvantages, makes it possible to build an economical, folding radome with a relatively simple structure which is light, stands up to atmospheric influences and strong winds, is easy to transport and set up and can be partially or totally folded at the choice of the user during use of the equipment which it protects.

The invention pertains to a radome for protection from atmospheric influences, with a folding, rigid reinforcing structure and a flexible roofing comprising one or more parts; a radome wherein, in order to prevent any formation of pockets, this roofing is made with a double wall and is sectioned into lens-shaped panels which are independent of one another and are inflatable.

BRIEF DESCRIPTION OF THE DRAWINGS

The invention will be better understood from the following description of a mode of embodiment with reference to the drawings, of which:

FIG. 10 depicts, on another scale, a partial and schematic view of a driving system for the main and secondary arches of the reinforcing structure of the radome of FIG. 3, FIG. 11 depicts a partial and schematic view of a device for tensioning the cables of the driving system of the main and arches of FIG. 10, FIG. 12 depicts, on another scale, a partial and schematic view of a pivoting system for the auxiliary arches of FIG. 6, and FIG. 13 depicts, on another scale, a partial and schematic view of a section of the main arches in the reinforcing structure of the radome of FIG. 3, showing one of the locking devices which join these main arches to one another.

DESCRIPTION OF THE PREFERRED EMBODIMENT

A radome according to the invention is applicable to any scientific, military, industrial or sports installation.

A folding radome 1 according to an illustrated example of an embodiment of the invention comprises a rigid, folding reinforcing structure 2 and a flexible roofing or cover 3 defining a part of a volume of revolution such as a portion of a sphere or ellipsoid. In the example illustrated, the folding radome 1 has a substantially hemispherical shape. The constituent elements of a hemispherical, folding radome 1 are applicable to the folding radomes of the invention having the shape of a part of another volume of revolution.

Figure 1:
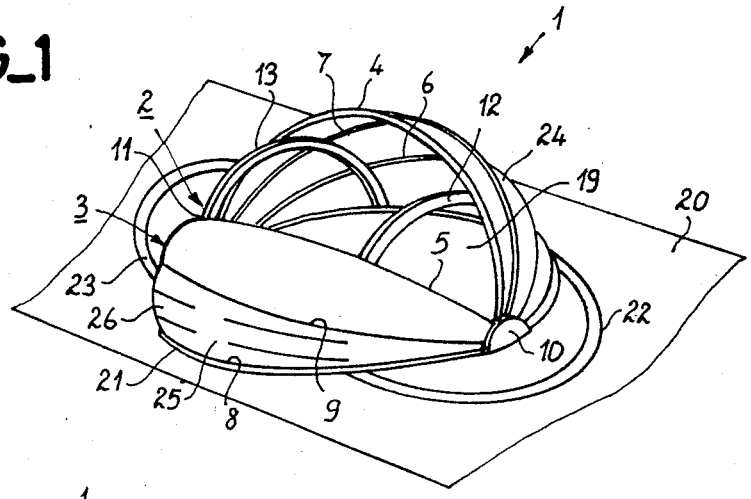
FIG. 1 depicts a schematic view, in perspective, of a folding radome made according to the invention, presenting it in a partially retracted position.
Figure 2:
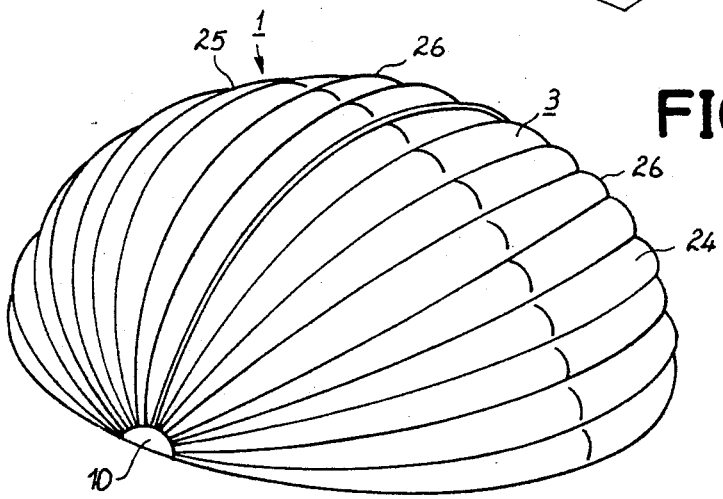
FIG. 2 depicts, on another scale, a view, in perspective, of the radome of FIG. 1 in its closed position.
Figure 3:
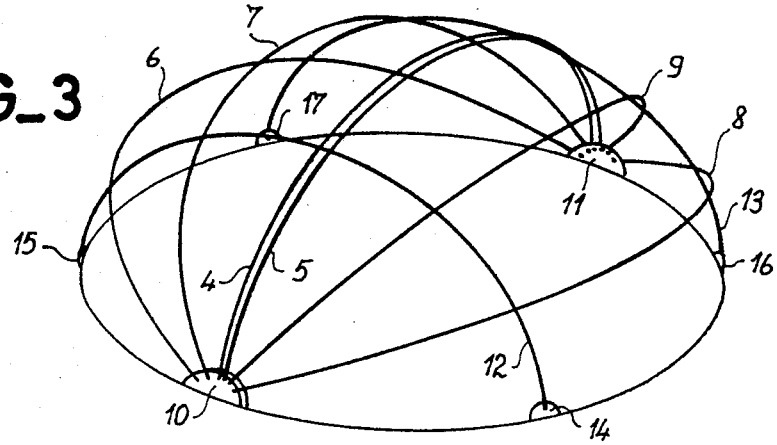
FIG. 3 depicts a partial schematic view, in perspective, of the radome of FIG. 2, the cover or roofing of which has been removed.

The rigid, folding reinforcing structure 7 comprises (FIGS. 1, 2, 3) firstly two main arches 4, 5, and preferably one or more secondary arches, 6, 7, 8, 9 pivoting at their ends around horizontal axes which are respectively offset vertically and laterally in two diametrically opposite pivoting supports 10, 11 (FIG. 5), and, secondly comprises, in a direction which is mutually perpendicular with these main and secondary arches, one or preferably two auxiliary arches 12, 13 each pivoting at their ends around horizontal axes located in two opposite hinge supports 14, 15 and 16, 17 at a height greater than that of the pivoting axes of the main arches 4 and 5. When the folding radome 1 is closed or elevated, the main arches 4, 5, the secondary arches 6, 7, 8, 9 and the auxiliary arches 12, 13 respectively take up positions depicted in FIG. 3 or partially depicted by dashes in FIG. 5.

Figure 5:
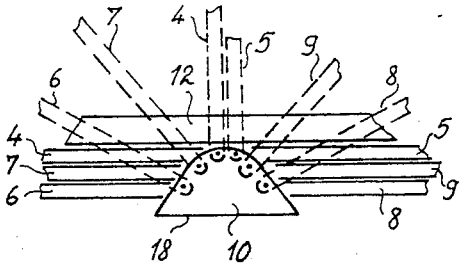
FIG. 5 depicts, on another scale, a partial, schematic view of a support for the pivoting of the ends of the main and secondary arches of the folding reinforcement structure of the of FIG. 3.

When the folding radome 1 is completely opened or when it is retracted, the main, secondary and auxiliary arches are superimposed and respectively take up positions represented by solid lines in FIG. 5. The auxiliary arches 12 and 13 thus become located respectively above the other main and secondary arches. To obtain easy entry into the open radome 1 and easy outlet from it for a transporting machine, especially a wheeled one, the floor 19 of this radome 1 and the platform 20 surrounding this radome (FIG. 1) are constructed in such a way as to have a level which is identical and equal to or greater than that of the auxiliary arches 12 and 13 in their partially retracted positions depicted in FIG. 5. The pivoting supports 10 and 11 are then fixed in a circular slit or trench 21, hollowed out or shaped in the platform 20. The main arches 4, 5 and secondary arches 6, 7, 8, 9 are arranged in this trench 21 when the radome 1 is completely opened while the two auxiliary arches 12 and 13 are respectively housed in the trenches or slits 22, 23 formed in this platform 20.

In a non-depicted, alternative mode of embodiment where the size of the radome is relatively small, the two auxiliary arches 12 and 13 which guide the motion of the main and secondary arches are reduced to a single auxiliary arch.

The flexible roofing or cover 3 of the folding radome 1 comprises two parts 24 and 25 (FIG. 2) each overlapping an area which is substantially equal to that of half a hemisphere. Each of the parts 24 and 25 is fixed by a first of its edges into the trench 21 against the floor 19 and by its second edge to one of the main arches 4, 5 while its central zone is fixed to the secondary arch or secondary arches 6, 7 or 8, 9.

Figure 4:
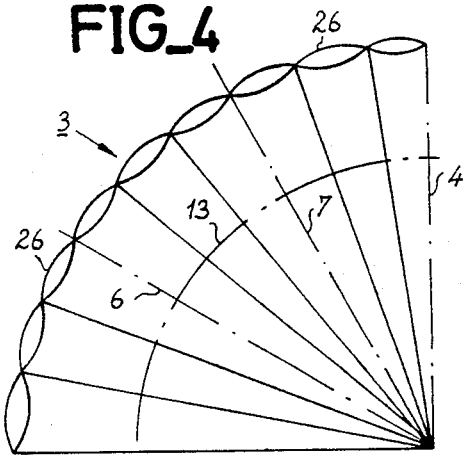
FIG. 4 depicts, on another scale, a partial, schematic, sectional view along a vertical plane IV—IV of the radome of FIG. 2, showing the roofing of this radome.

Each of the parts 24, 25 of the flexible roofing or cover 3 (FIG. 4) forms a double-walled assembly sectioned into inflatable panels 26 which are independent, i.e. which cannot communicate with one another by their side partitions, are hermetic and which have a lens-shaped, i.e. substantially elliptical, cross-section. These panels 26 with a lens-shaped section, which are inflatable at a predetermined pressure, act as inflatable multiple-beams and enable the flexible roofing 3 to hold itself up alone and efficiently stand up to the wind, even without the rigid, folding reinforcing structure 2. In a combination where a rigid, folding reinforcing structure 2 is solidly fixed by its main arches 4, 5 and secondary arches 6, 7, 8, 9 to the flexible roofing 3 along the corresponding edges of the panels 26, these inflatable, lens-shaped panels 26 can be used to boost the mechanical resistance of the radome 1 to atmospheric influences, especially to strong winds of 250 kilometers/hour or more. In comparison with a radome of the known art using a fixed metallic frame and an flexible roofing inflated from within this radome, and for a predetermined mechanical resistance of the radome to winds of a given maximum speed, the advantage of the folding radome 1 is that, by means of a roofing 3 with lens-shaped panels 26, it possesses a folding, reinforcing structure 3 which is lighter than the fixed frame of the radome of the prior art. This advantage promotes the easier installation of the folding radome 1 in places which are difficult to reach by terrestrial wheeled or chain-fitted means of transport.

Certain radomes of the prior art comprise a roofing or a flexible wall in which cylindrical bulging sections are shaped and inflated to rigidify this wall or roofing or to act as beams to keep this wall or roofing in position. However, during deflation resulting from an accidental leakage of inflating fluid or the puncturing of one of these bulging sections, the surface tension of the radome roofing or wall is interrupted all along the place occupied by this inflated bulging section, and a pocket may be formed as the area of the material forming the cylindrical sheathing of the deflated bulging section is always greater than that occupying its diameter, and this difference in dimension is not absorbed or compensated by any available traction force exerted on this cover or wall, the other cylindrical bulging sections being already inflated to their maximum predetermined degree. In the case of a radome of the prior art, comprising an internal inflating system, this inflation often proves to be inadequate or inefficient in re-establishing the tension of the roofing of this radome where there is an accidental deflation of one of these beams which take the shape of inflatable, cylindrical bulging sections. A lack of tension in the roofing of a radome at the location of a deflated cylindrical bulging section usually causes fluttering and a blow-out which tears the roofing of the radome at this location under the action of a strong wind. The formation of a pocket in the roofing at the location of a deflated cylindrical bulging section even further weakens the resistance of this roofing to strong winds.

In the folding radome 1, when a lens-shaped panel 26 of the roofing 3 is accidentally deflated, the neighbouring lens-shaped panels 26 become rounded out in varying degrees and instantaneously creates a traction force on the roofing 3 at the position of the deflated panel in such a way as to constantly keep this roofing 3 under tension and prevent any disadvantageous formation of a pocket or slack part in this roofing which would create zones of weakness in the resistance to winds. The lens shape thus gives the inflated panels 26 a constantly available traction power over the surrounding zones of roofing 3, and enables these panels 26 to maintain a uniformity of tension throughout the surface of this roofing 3.

In the folding radome 1, a combination of a rigid, folding reinforcing structure 2, a flexible roofing 3 with inflatable lens-shaped panels 3 and a created internal pressure which is substantially equal to the dynamic pressure of a wind with predetermined characteristics can be used to give this folding radome 1 a even better mechanical resistance to this wind as compared to the combination of a reinforcing structure 2 and a roofing 3 with inflatable lens-shaped panels 26 as described in an earlier paragraph, and can give it excellent operational reliability.

Even with an accidental absence of the internal pressure created in this folding radome 1, the lens-shaped panels 26 always keep the roofing 3 under tension and hences reduce or remove the vulnerability of the installation. In the event of an accidental tear of the external wall of the roofing 3 at the location of a panel, the internal wall gets pressed against the external wall under the action of the internal pressure and/or the traction force exerted on the neighbouring panels which become rounded out in varying degrees and thus plug up or block up this tear, thus making it possible to prevent any worsening of this accident.

The systems for inflating the lens-shaped panels 26 and creating internal pressure in the radome 1 are systems of a known type which are not described in detail below.

The folding, reinforcing structure 2 is preferably made of a known material such as a metal, a metal alloy or a composite, synthetic material which is mechanically resistant, light and hardly vulnerable or invulnerable to corrosion.

The flexible roofing 3 is preferably made of an impermeable, mechanically resistant fabric such as one provided with a polyester support lined with a vinyl polychloride based coating.

The folding radome 1 may have a diameter equal to fifty meters or more and a height equal to thirty meters or more.

In the folding, reinforcing structure 2, the main arches 4, 5 and the secondary arches 6, 7, 8, 9 are made of a material chosen from among structural sections, angle brackets and tubes, shaped and provided with holes so thast they can be fastened to the roofing 3 by means of screws or bolts. The roofing 3 can be strengthened at the points of its fastening to the reinforcing arches 2 by known reinforcement pieces such as plates, washers etc.

Figure 6:
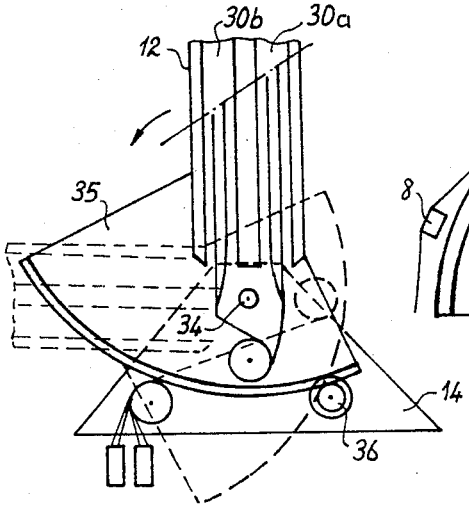
FIG. 6 depicts, on another scale, a partial and schematic view of a system for the pivoting of the ends of the auxiliary arches of the reinforcing structure of the radome of FIG. 3.
Figure 7:
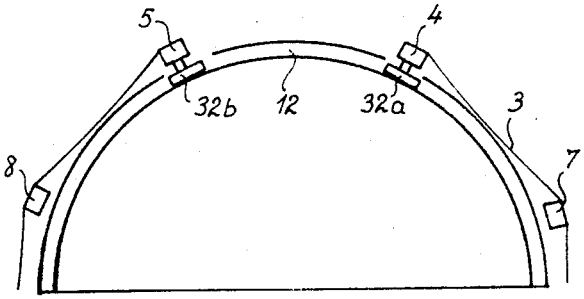
FIG. 7 depicts, on another scale, a partial and schematic view of an auxiliary arch of the reinforcing structure of the radome of FIG. 3, depicting travelling devices which drive the main and secondary arches.
Figure 8:
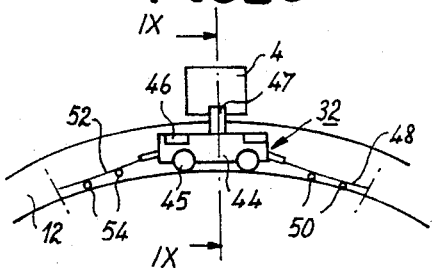
FIG. 8 depicts, on another scale, a schematic view of a section of an auxiliary arch of FIG. 7.
Figure 9:
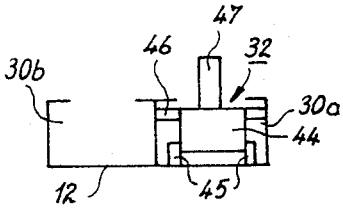
FIG. 9 depicts, on another scale, a schematic, partial, sectional view along a plane IX—IX of the auxiliary arch of FIG. 8, depicting a travelling device which drives the and secondary arches.

In the example illustrated (FIGS. 6, 7, 8, 9), the auxiliary arches 12, 13 comprise structural sections made of metal or of a resistant metallic alloy which is hardly vulnerable or invulnerable to corrosion, with an E-shaped cross-section (FIG. 9) each defining two parallel sliding tracks $30_a$, $30_b$ or $31_a$, $31_b$ respectively for two of the four identical travelling devices $32_a$, $32_b$ or $33_a$, $33_b$ of a system to operate the closing and opening of the flexible roofing of the radome 1. Each of the sliding tracks 30 or 31 preferably has a C-shaped cross-section. The ends of the arches 12 and 13 rotate around horizontal axes such as 34 in FIG. 6, in hinge supports 14, 15, 16, 17 respectively, and each of them carries a pivoting system comprising a sector gear 35 and a driving pinion 36 which is driven, through a coupling 37, by a motor-reduction gear 38. The driving motion of the two driving pinions 36a, 36b is synchronized (FIG. 12) by a system comprising two impulse transmitters $39_a$, $39_b$ respectively mounted on the shafts of the motor-reduction gears $38_a$, $38_b$ of which one, $38_b$, is controlled or monitored, the system further comprising a comparator 40 of the data transmitted by these impulse transmitters $39_a$, $39_b$, an amplifier 41 of the output signal of this comparator 40 and a variable speed drive unit 32 receiving the actuating signal that comes from this amplifier 41 to correct the speed of the motor reduction gear $38_a$ and make it constantly equal to the speed of the motor reduction gear $38_b$ which is controlled or monitored. By means of this synchronization, the pinions $36_a$, $36_b$ drive the sector gears $35_a$ and $35_b$ at the same speed to pivot the auxiliary arch $34_a$, $34_b$ either in its low, retracted position, partially illustrated in FIG. 5, or in its top position, illustrated in FIG. 1.

The auxiliary arch 13 comprises a structure which is the same as that of the arch 12 and that of the pivoting systems 35, 36, 37, 38 and synchronization systems 39, 40, 41, 42 which are identical to those of this auxiliary arch 12 described above.

Each of the travelling devices $32_a$, $32_b$, $33_a$ and $33_b$ of a pair of travelling devices 32, 33 which slide in the tracks 30 and 31 respectively of an auxiliary arch 12 or 13, comprises (FIGS. 8, 9) a body 44 provided with roller wheels 45 and guide wheels 46 supported by the bottom and side walls of these tracks, and surmounted by a fastening support 47 to which is fastened a corresponding main arch 4 or 5. Each of the travelling devices $32_a$, $32_b$ is respectively pulled, on the one hand, in one direction, by a traction cable or cables $48_a$, $48_b$ of a driving system comprising (FIGS. 8, 10) a drum $49_a$, $49_b$ for the storage of the traction cables $48_a$, $48_b$, return pulleys $50_a$, $50_b$, a motor-reduction gear $51_a$, $51_b$ and, on the other hand, in an opposite direction, by a pull-back cable or cables $52_a$, $52_b$ of a winding system comprising (FIGS. 8, 10, 11) a drum $53_a$, $53_b$, return pulleys $54_a$, $54_b$, a motor-reduction gear $55_a$, $55_b$ for driving this drum $53_a$, $53_b$ and a counterweight device $56_a$, $56_b$ for the proper tensioning of the pull-back cables $52_a$, $52_b$ and traction cables $48_a$, $48_b$.

Similarly to the travelling devices $32_a$, $32_b$, the travelling devices $33_a$ and $33_b$ of the auxiliary arch 13 are respectively pulled, on the one hand, in one direction, by a traction cable or cables $58_a$, $58_b$ of a driving system comprising (FIG. 10) a drum $59_a$, $59_b$ for the storage of the traction cables $58_a$, $58_b$, return pulleys $60_a$, $60_b$, a motor-reduction gear $61_a$, $61_b$ and, on the other hand, in an opposite direction, by a pull-back cable or cables $62_a$, $62_b$ of the travelling devices $32_a$, $32_b$ of the auxiliary arch 12, in other words a drum for the storage of these pull-back cables, return pulleys, a motor-reduction gear for driving this storage drum and a counterweight device which properly tensions these pull-back cables $62_a$, $62_b$ and traction cables $58_a$, $58_b$.

The main arches 4 and 5 are also fixed respectively to the fastening supports of the travelling devices $33_a$ and $33_b$ of the auxiliary arch 13 (FIG. 10). Synchronization of the pivoting of each of the main arches 4 and 5 by motor-reduction gears $51_a$ and $61_a$ or $51_b$ and $61_b$ is provided by a system comprising impulse transmitters $65_a$ or $65_b$ and $66_a$ or $66_b$ mounted on the shaft of the corresponding motor-reduction gears $51_a$ or $51_b$ and $61_a$ or $61_b$, one of which $51_a$ or $51_b$ is controlled or monitored, a comparator $67_a$, $67_b$ of the data transmitted by these impulse transmitters $65_a$ or $65_b$ and $66_a$ or $66_b$, an amplifier $68_a$ or $68_b$ of the output signal of this comparator and a variable speed drive unit $69_a$ or $69_b$ which receives a control signal transmitted by this amplifier $68_a$ or $68_b$ and rectifies the speed of the motor-reduction gear $61_a$ or $61_b$ in order to make it equal to that of the motor-reduction gear $51_a$ or $51_b$. The result of this is that, during the synchronized functioning of the motor-reduction gears $51_a$ and $61_a$ or $51_b$ and $61_b$, the traction cables $48_a$ and $58_a$ or $48_b$ and $58_b$ are pulled simultaneously in order to bring the corresponding travelling devices $32_a$ and $33_a$ or $32_b$ and $33_b$, hence the main arch 4 or the main arch 5 towards the floor 19, in other words, in order to fold or retract the folding radome 1.

The winding of the pull-back cables $52_a$ and $62_a$ or $52_b$ and $62_b$ of the travelling devices $32_a$ and $33_a$ or $32_b$ and $32_b$ by the corresponding motor-reduction gears 55 is synchronized by a system similar to that which regulates the motor-reduction gears $51_a$ and $61_a$ (FIG. 10).

When the pull-back cables $52_a$ and $62_a$ or $52_b$ and $62_b$ are pulled, the corresponding travelling devices $32_a$ and $33_a$ or $32_b$ and $33_b$, hence the main arch 4 or the main arch 5, are drawn upwards, making it possible to unfold the folding radome 1, in other words to close this folding radome.

The main arches 4 and 5 preferably comprise one or more locking devices 70 making it possible to bind them together and block the closing of the folding radome 1. One of these locking devices is schematically illustrated in FIG. 13. This locking device 70 comprises, for example, firstly a substantially rectangular catch 71 which is integrally joined to the first of the two main arches, represented by dashes, which pivots around an axis perpendicular to the plane of its body under the actuation of a motor 72 and comprises, secondly, a rectangular opening 73, shaped in the second arch 4 of these main arches, for the passage of this catch 71, this opening being provided, on its longitudinal edges, with opposite, rising ramps 74, 75 represented by dashes. When the catch passes through the opening 73 in the main arch 4, pivots and rises up the slopes of these opposite ramps 74, 75, the main arch 4 is clamped against the main arch 5 and blocks the closing of the folding radome 1. Flexible joints 76, 77, which may or may not be inflated, are mounted on the surfaces in contact with the main arches 4 and 5 to reinforce the imperviousness of the closing of the radome 1 and, should the occasion arise, to prevent the leaking of fluid under pressure creating an internal pressure against this folding radome 1. The devices 70 may be replaced by any other known closing devices.

When the radome 1 is folded or retracted, the equipment protected by this radome is entirely free to be in communication with the external atmosphere. The retracted radome 1 does not hamper the equipment as regards vision, transmission or reception, and creates no electrical, magnetic or luminous disturbances, provides efficient protection from atmospheric influences and superbly withstands strong winds with great operating reliability. Radomes of the prior art do not possess all these characteristics. Furthermore, the folding radome 1 comprises a light structure which makes it easy to set up, and a simple mode of operation which makes it easy to use.

Obviously, numerous modifications and variations of the present invention are possible in light of the above teachings. It is therefore to be understood that within the scope of the appended claims, the invention may be practiced otherwise than as specifically described herein.

What is claimed is:

1. A radome for protection from atmospheric influences, with a folding, rigid reinforcing structure and a flexible roofing which includes one or more parts, comprising: a radome which includes a roof made with a double wall and sectioned into a plurality of interconnected, inflatable, hermetic lens-shaped panels which are independent of one another and which are substantially elliptical in cross-section and are inflated at a predetermined pressure so as to increase mechanical resistance to atmospheric influences.

2. A radome according to the claim 1 comprising a combination of a folding, rigid reinforcing structure, a flexible roofing sectioned into inflatable, lens-shaped panels which are independent of one another and an internal pressure created in the radome, said pressure being equal to the dynamic pressure of a wind with predetermined characteristics.

3. A radome according to one of the claims 1 and 2, wherein, in the folding rigid reinforcing structure comprising main and secondary arches and comprising, in a direction mutually perpendicular with these main and secondary arches, auxiliary arches pivoting and hinged on its ends, the main and secondary arches are made of a material chosen from among structural sections, angle brackets and tubes, and the auxiliary arches are made of structural sections with an E-shaped cross-section, each defining two parallel sliding tracks, individually having C-shaped cross-sections.

4. A radome according to one of the claims 1 and 2, wherein the folding, rigid reinforcing structure comprises two main arches pivoting on their ends and, in a direction which is mutually perpendicular with that of these main arches, a single auxiliary arch pivoting and hinged on its ends.

5. A radome according to the claim 3 comprising, in the folding, rigid reinforcing structure, horizontal axes for the pivoting of the ends of the main and secondary arches, respectively offset vertically and laterally in their supports, wherein, in the folding reinforcing structure, the horizontal pivoting axes of the auxiliary arches are in their supports at a height greater than that of the horizontal pivoting pints of the ends of the main arches so that, when the radome is completely opened, the auxiliary, main and secondary arches are respectively superimposed.

6. A radome according to claim 3 comprising pivoting arches provided, at their ends, with sector gears, wherein, in the folding reinforcing structure, the auxiliary arches pivoting around horizontal axes in the supports are provided at each of their ends with a pivoting system comprising a sector gear and a drive pinion driven through a coupling by a motor-reduction gear.

7. A radome according to claim 1, wherein the folding reinforcing piece comprises an operating system for closing and opening provided with travelling devices which are fixed on main arches of said reinforcing structure, actuated by cables and sliding in auxiliary arches of said reinforcing structure.

8. A radome according to the claim 7, wherein, in the operating system for closing and opening, the travelling devices each comprise a body provided with roller wheels and guide wheels supported on bottom and side walls of the sliding tracks formed in the auxiliary arches of the folding reinforcing structure.

9. A radome according to one of the claims 7 and 8, wherein, in the operating system for closing and opening, the travelling devices are pulled in diametrically opposite directions by traction cables and pull-back cables respectively driven by a system comprising a cable-storage drum, a motor-reduction gear and return pulleys.

10. A radome according to the claim 9, wherein, in the operating system for closing and opening, the motor-reduction gears, one of which is controlled or monitored, are synchronized in their operation by a system comprising two impulse transmitters mounted on the shafts of these motor-reduction gears, a comparator of the data transmitted by these impulse transmitters, an amplifier of the output signal of this comparator and a variable speed drive unit receiving the control signal from this amplifier and rectifying the speed of the controlled motor-reduction gear to make the said speed equal to that of the monitored motor-reduction gear.

11. A radome according to the claim 6 wherein, in the pivoting system of the auxiliary arches, the motor-reduction gears, one of which is controlled or monitored, are synchronized by a system comprising two impulse transmitters mounted respectively on the shafts of these motor-reduction gears, a comparator of the data transmitted by these impulse transmitters, an amplifier of the output signal of this comparator, and a variable speed drive unit receiving the control signal from this amplifier and rectifying the speed of the controlled motor-reduction gear to make the said speed equal to the speed of the monitored motor-reduction gear.

12. A radome according to claim 1, wherein said panels comprise pressurized panels having an internal pressure which is substantially equal to a predetermined dynamic pressure of the atmosphere outside said radome.

13. A radome according to claim 1, further comprising means for rounding out adjacent panels of a deflated panel so as to reinforce said roofing.

14. A radome for protection from atmospheric influences, with a folding, rigid reinforcing structure and a flexible roofing which includes one or more parts, comprising; a radome which includes a roof made with a double wall and sectioned into a plurality of interconnected, inflatable, hermetic lens-shaped panels which are independent of one another and which are substantially elliptical in cross-section wherein said panels are biconvex in cross-section and said panels do not communicate with one another and are inflated at a predetermined pressure so as to increase mechanical resistance to atmospheric influences.

15. A radome according to claim 14, wherein said panels comprise pressurized panels having an internal pressure which is substantially equal to a predetermined dynamic pressure of the atmosphere outside said radome.

16. A radome according to claim 14, further comprising means for rounding out adjacent panels of a deflated panel so as to reinforce said roofing.

* * * * *